US008044652B2

(12) United States Patent
Okuda

(10) Patent No.: US 8,044,652 B2
(45) Date of Patent: Oct. 25, 2011

(54) CONSTANT CURRENT CONTROL CIRCUIT

(75) Inventor: Shouichi Okuda, Nukata-gun (JP)

(73) Assignee: DENSO CORPORATION, Kariya (JP)

( * ) Notice: Subject to any disclaimer, the term of this patent is extended or adjusted under 35 U.S.C. 154(b) by 331 days.

(21) Appl. No.: 12/457,710

(22) Filed: Jun. 18, 2009

(65) Prior Publication Data

US 2009/0315524 A1 Dec. 24, 2009

(30) Foreign Application Priority Data

Jun. 19, 2008 (JP) ..... 2008-160258
Mar. 10, 2009 (JP) ..... 2009-056417

(51) Int. Cl.
*G05F 3/04* (2006.01)

(52) U.S. Cl. ..... 323/312; 323/267

(58) Field of Classification Search ..... 323/220, 323/246, 264, 267, 268, 273, 312; 327/108, 327/109, 110

See application file for complete search history.

(56) References Cited

U.S. PATENT DOCUMENTS

| | | | | |
|---|---|---|---|---|
| 4,740,737 | A * | 4/1988 | Schiavon | 318/696 |
| 7,468,619 | B2 * | 12/2008 | Okuda | 327/108 |
| 7,570,085 | B2 * | 8/2009 | Ishikawa et al. | 327/108 |
| 2007/0296468 | A1 | 12/2007 | Okuda | |

FOREIGN PATENT DOCUMENTS

| | | |
|---|---|---|
| JP | A-03-077357 | 4/1991 |
| JP | A-10-264765 | 10/1998 |
| JP | A-10-297420 | 11/1998 |
| JP | A-11-097203 | 4/1999 |
| JP | A-2004-347427 | 12/2004 |
| JP | A-2005-088748 | 4/2005 |

* cited by examiner

*Primary Examiner* — Adolf Berhane
(74) *Attorney, Agent, or Firm* — Posz Law Group, PLC

(57) ABSTRACT

A constant current control circuit is disclosed. Pads are connected with a common power supply terminal. Shunt resistors are located outward of a region containing Pch type MOS transistors. A temperature increase of the shunt resistors due to a temperature increase of the MOS transistors can be suppressed by the above structure. In particular, when the MOS transistor of one circuit system is driven, the shunt resistor of another circuit system is distant from the driving MOS transistor, and thus, it is possible to further suppress the temperature increase of the distant shunt resistor. Moreover, a power supply terminal can be provided as a single common terminal, and the number of terminals can be reduced.

8 Claims, 14 Drawing Sheets

CONSTANT CURRENT CONTROL CIRCUIT

CROSS REFERENCE TO RELATED APPLICATION

The present application is based on Japanese Patent Applications No. 2008-160258 filed on Jun. 19, 2008 and No. 2009-056417 filed on Mar. 10, 2009, the disclosures of which are incorporated herein by reference.

BACKGROUND OF THE INVENTION

1. Field of the Invention

The present invention relates to a constant current control circuit having a built-in shunt resistor for detecting a constant current flowing toward a load, more specifically relates to a squib drive circuit for use in a vehicle to control a constant current flowing toward a squib resistor for airbag inflation.

2. Description of Related Art

As one type of constant current control circuit having a built-in shunt resistor, there is known a squib drive circuit that controls inflation of an in-vehicle airbag by controlling a constant current flowing toward a squib resistor. Such a squid drive circuit can be implemented in an airbag IC (integrated circuit). According to the prior art including JP-2005-88748A, JP-2007-328683A corresponding US-2007/0296468A, JP-H10-264765A and JP-H10-297420, the shunt resistor is provided not on a squib resistor terminal side but a power supply terminal side in order to avoid an ESD (Electrostatic Discharge) input.

In a conventional constant current control circuit, however, it has been difficult to suppress an increase in temperature of a built-in shunt resistor. Further, it has been difficult to reduce the number of terminals.

SUMMARY OF THE INVENTION

In view of the above and other difficulties, it is an objective of the present invention to provide a constant current control circuit that can suppress an increase in temperature of a built-in shunt resistor, and that can employ a common power supply terminal.

According to an aspect of the present invention, a constant current control circuit is provided. The constant current control circuit is coupled with a first external load and a second external load. The constant current control circuit includes: a power supply terminal that a power supply voltage is applied to; a first semiconductor switching element that is connected with the power supply terminal and controls a first constant current, the first constant current flowing toward the first external load based on the power supply voltage; a second semiconductor switching element that is connected with the power supply terminal and controls a second constant current, the second constant current flowing toward the second external load based on the power supply voltage; a first output terminal that is connected with the first external load; a second output terminal that is connected with the second external load; a first shunt resistor that is connected between the first external load and the first semiconductor switching element, and detects the first constant current; a second shunt resistor that is connected between the second external load and the second semiconductor switching element, and detects the second constant current; a step up circuit that steps up the power supply voltage by a predetermined voltage; a first drive circuit that is driven based on the stepped up power supply voltage, and controls the first semiconductor switching element based on the first constant current detected by the first shunt resistor; a second drive circuit that is driven based on the stepped up power supply voltage, and controls the second semiconductor switching element based on the second constant current detected by the second shunt resistor; a first pad that is connected with the first semiconductor switching element; and a second pad that is connected with the second semiconductor switching element. The first semiconductor switching element and the second semiconductor switching element are arranged in a same chip and located adjacent to each other in the chip. The first and second pads are located between the first semiconductor switching element and the second semiconductor switching element. The first and second pads are electrically connected with the power supply terminal, which is a single terminal common to the first and second pads. The first and second shunt resistors are located outward of a region containing the first and second semiconductor switching elements.

According to the above constant current control circuit, the first and second shunt resistors can be located not between the first and second semiconductor switching elements but outward of the region containing the first and second semiconductor switching elements. Therefore, a temperature increase of the first and second shunt resistors due to a temperature increase of the first and second semiconductor switching elements can be suppressed. In particular, for example, when the first semiconductor switching element of one circuit system is driven, the second shunt resistor of another circuit system is distant from the driving first semiconductor switching element, and thus, a temperature increase of the second shunt resistor can be suppressed. Further, the first and second pads can be connected with the power supply terminal, which is the single and common terminal. Therefore, the number of terminals can be reduced.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE EXEMPLARY EMBODIMENTS

In embodiments, a constant current control circuit is illustrated by using a squib drive circuit for use in a vehicle to control airbag inflation.

Figure 10:
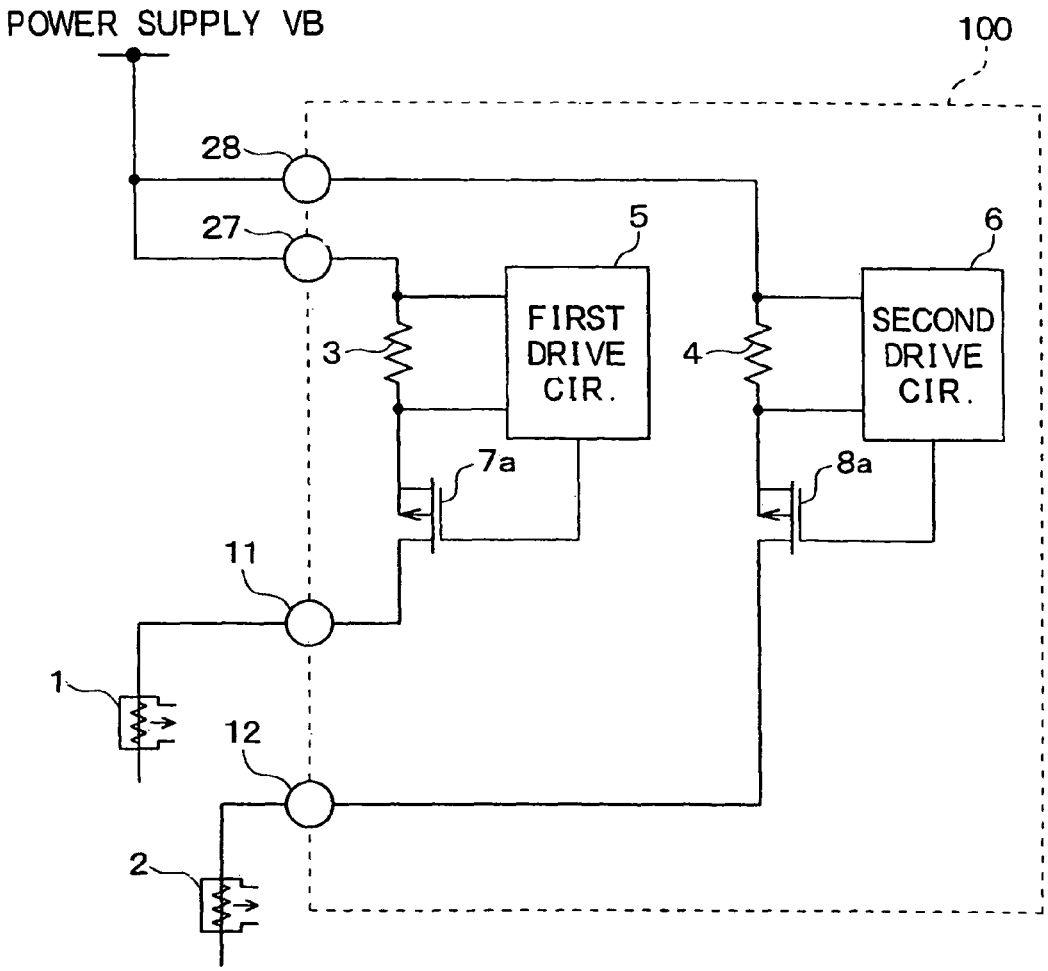
FIG. 10 is a block diagram illustrating a squib drive circuit according to a first comparison example
Figure 11:
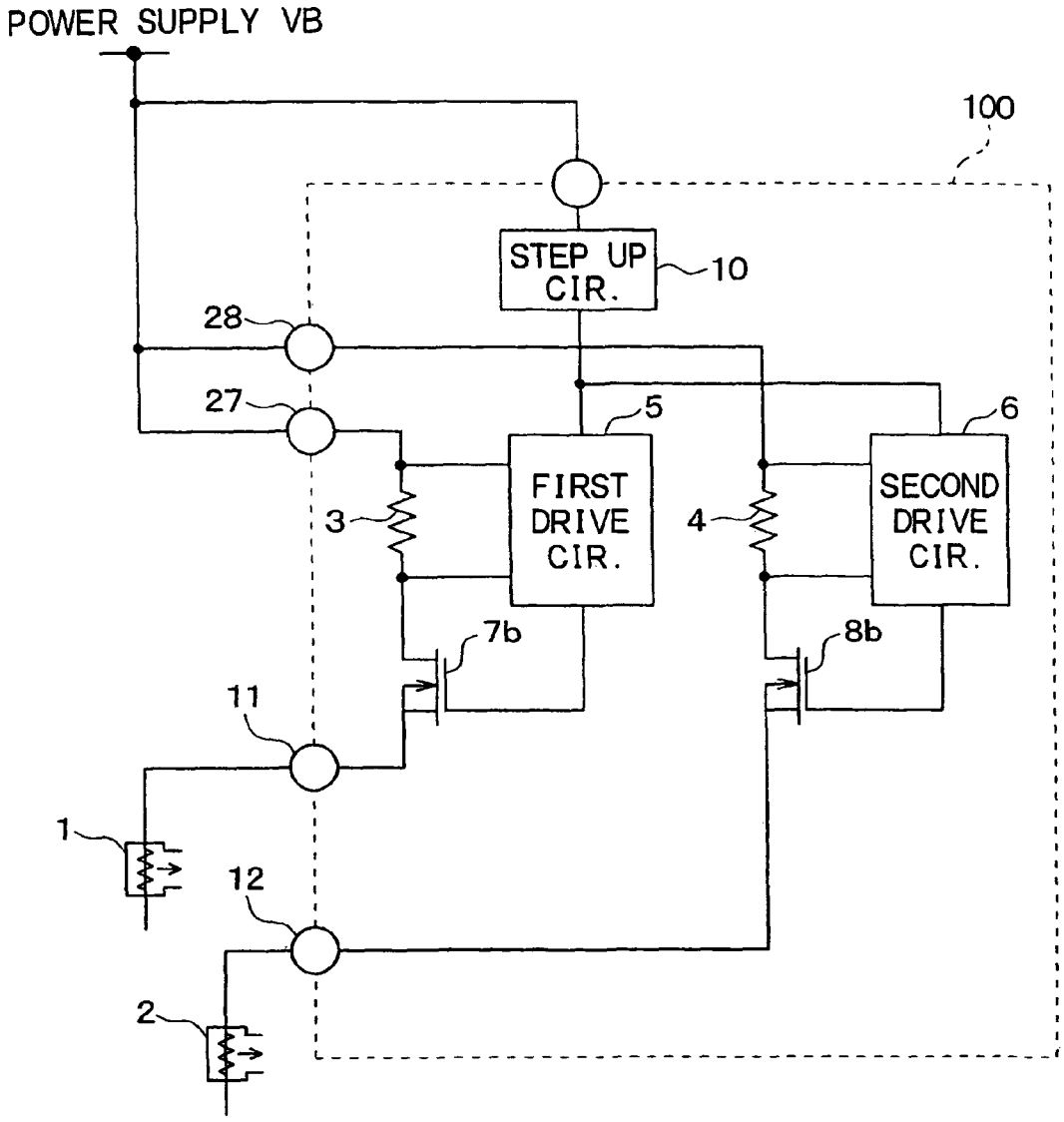
FIG. 11 is a block diagram illustrating a squib drive circuit according to a second comparison example.
Figure 12:
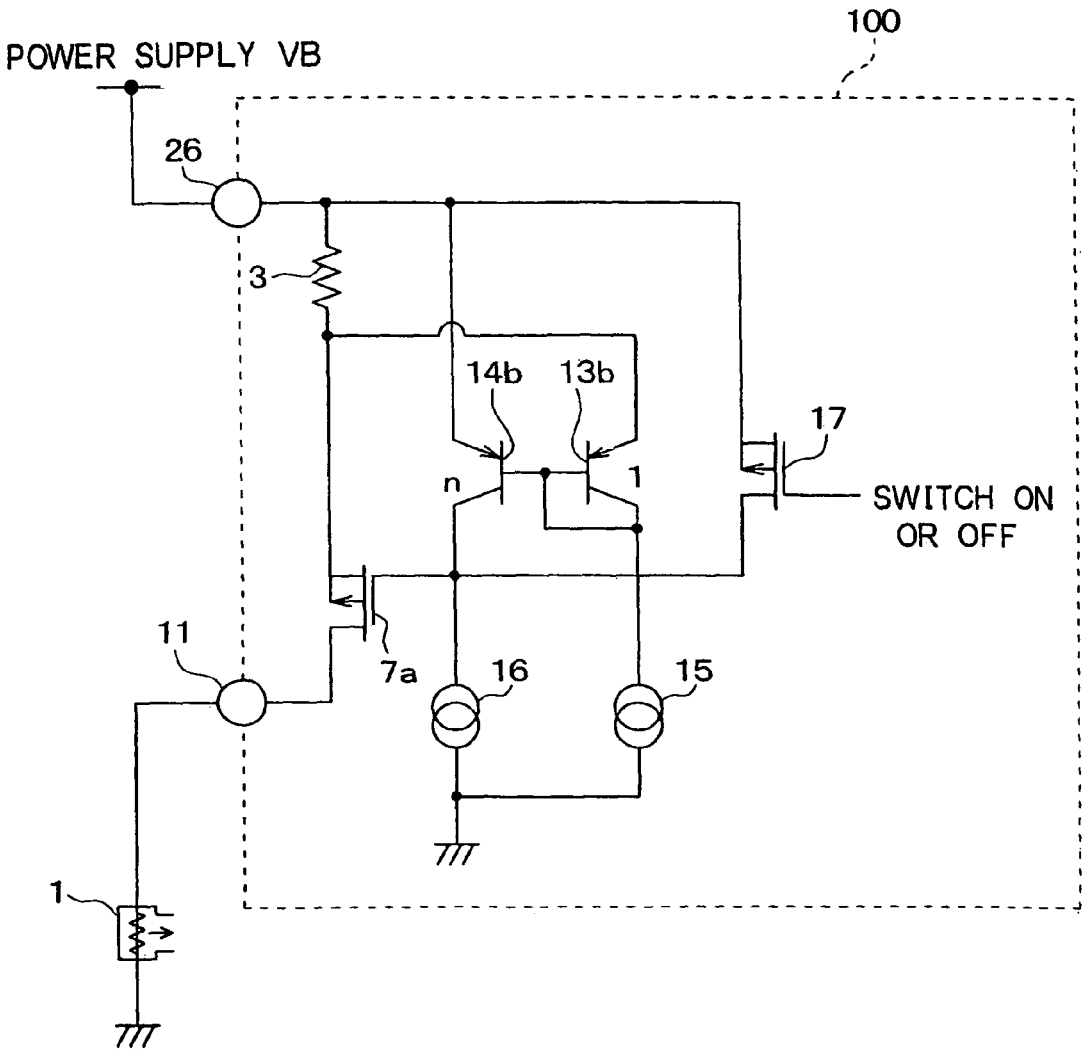
FIG. 12 is a diagram illustrating a circuit configuration of the squib drive circuit illustrated in FIG. 10.
Figure 13:
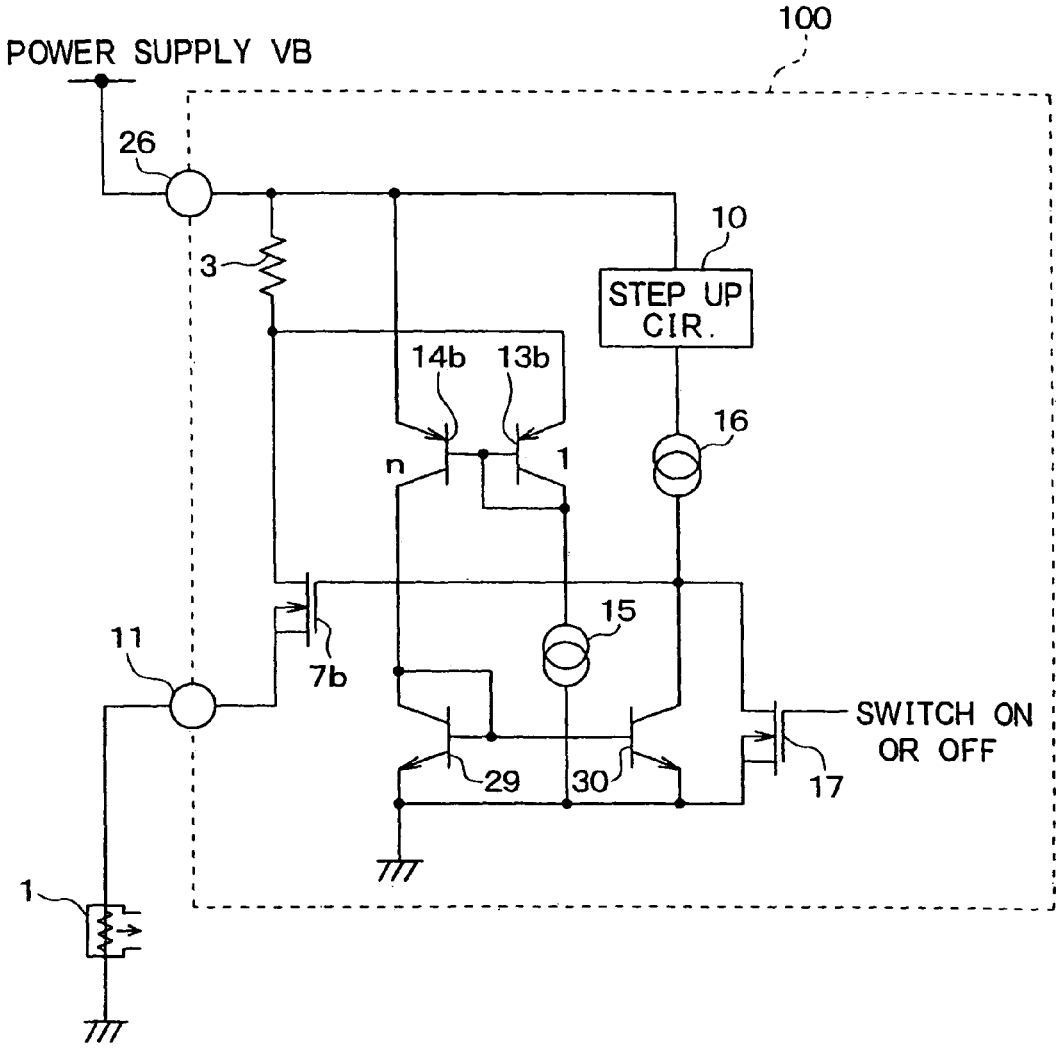
FIG. 13 is a diagram illustrating a circuit configuration of the squib drive circuit illustrated in FIG. 11.

Referring to FIGS. 10 to 14, a squib drive circuit 100 according to one embodiment is described below as comparison examples. FIG. 10 illustrates a squib drive circuit 100 that employs a Pch type MOS transistor as a semiconductor switching element functioning as a high-side switch. FIG. 11 illustrates a squib drive circuit 100 that employs an Nch type MOS transistor as a high-side switch. FIG. 12 illustrates a specific circuit configuration of the squid drive circuit shown in FIG. 10. FIG. 13 illustrates a specific circuit configuration of the squib drive circuit shown in FIG. 11. It should be noted that, among multiple circuit systems of the squib drive circuit shown in FIGS. 10, 11, only a circuit system for driving a squib resistors is shown in FIGS. 12, 13. Another circuit system of the squib drive circuit 100 may have a circuit configuration similar to that shown in FIGS. 12, 13.

The squib drive circuit 100 shown in each of FIGS. 10 and 11 performs constant current control by converting of currents flowing toward squib resistors 1, 2 into voltages by using shunt resistors 3, 4, transferring the voltages to the first and second drive circuits 5, 6, and feedback-controlling gate voltages of the Pch type MOS transistors. The squib resistors 1, 2 respectively acts as first and second external load and correspond to airbags, which can be equipped in various parts of the vehicle. The squib resistors 1, 2 can cause explosion for the airbags to inflate.

The squib drive circuit 100 shown in FIG. 10 has the following configuration. The Pch type MOS transistors 7*a*, 8*a* function as high-side switches. The shunt resistors 3, 4 are connected on a high side more than the Pch type MOS transistors 7*a*, 8*a*. A power supply voltage VB is applied to the shunt resistors 3, 4, a first drive circuit 5, and a second drive circuit 6 via power supply terminals 27, 28. The Pch type MOS transistors 7*a*, 8*a* are respectively connected with the squib resistors 1, 2 via output terminals 11, 12. Because of the above-described configuration, voltage drops across the shunt resistors 3, 4 are respectively inputted to the first and second drive circuits 5, 6. Accordingly, gate electric potentials of the Pch type MOS transistors 7*a*, 8*a* are controlled, and the currents flowing toward the squib resistors 1, 2 are controlled.

More specifically, as shown in FIG. 12, bases of two PNP transistors 13*b*, 14*b* are connected with each other so as to establish current-mirror connection whose current mirror ratio is set to 1:n. An emitter of one PNP transistor 13*b* is connected with a low-side of the shunt resistor. An emitter of the other PNP transistor 14*b* is connected with a high-side of the shunt resistor. Collectors of the PNP transistors 13*b*, 14*b* are respectively connected with constant current circuits 15, 16. A connection point between the collector of the PNP transistor 14*b* and the constant current circuit 16 is connected with the gate of the Pch type MOS transistor 7*a*. By switching on and off a drive transistor 17, the power supply voltage VB is applied to the gate of the Pch type MOS transistor 7*a*.

In a normal state of the above-configured squib drive circuit 100, the drive transistor 17 is in ON, and thus, the Pch type MOS transistors 7*a*, 8*a* are in OFF, and currents do not flow toward the squib resistors 1, 2. In timing for airbag to inflate following vehicle collision detection or the like, the drive transistor 17 is switched on and the gate of the Pch type MOS transistor 7*a* is subjected to a voltage lower than "the power supply voltage VB minus a threshold voltage VT". Thereby, the Pch type MOS transistor 7*a* is switched on, and the current is allowed to flow through the squib resistor 1. Then, the current flowing toward the squib resistor 1 is converted into a voltage by the shunt resistor 3. When the current flowing through the PNP transistors 13*b*, 14*b* is changed due to a change in voltage drop across the shunt resistor 3, the gate electric potential of the Pch type MOS transistor 7*a* is controlled in accordance with the change, and the source-drain current of the Pch type MOS transistor 7*a* is controlled. Through the above-described operation, the constant current control is performed so that the current flowing toward the squib resistor 1 is maintained constant.

A squib drive circuit 100 illustrated in FIG. 11 has the following configuration. Nch type MOS transistors are used as high-side switches. The shunt resistors 3, 4 are connected on a high side more than the Nch type MOS transistors 7*b*, 8*b*. The power supply voltage VB is applied to the shunt resistors 3, 4 via the power supply terminals 27, 28, respectively. The Nch type MOS transistors 7*b*, 8*b* are respectively connected with the squib resistors 1, 2 via the output terminals 11, 12. The squib drive circuit 100 shown in FIG. 11 includes a step up circuit 10, differently from the squib drive circuit 100 shown in FIG. 10, which uses the Pch type MOS transistors 7*a*, 8*a* as high-side switches. The step up circuit 10 steps up the power supply voltage VB and applies the stepped up power supply voltage VB to the first and second drive circuits 5, 6, in order for the squib drive circuit 100 to normally operate even when electric potentials of the output terminals change to as high as the power supply voltage VB. Because of the above-described configuration, by respectively inputting voltage drops across the shunt resistors 3, 4 to the first and second drive circuits 5, 6, the gate potentials of the Nch type MOS transistors 7*b*, 8*b* are controlled, and the currents flowing toward the squib resistors 1, 2 are controlled.

More specifically, as shown in FIG. 13, bases of two PNP transistors 13*b*, 14*b* are connected with each other so as to establish current-mirror connection whose current mirror ratio is set to 1:n. An emitter of one PNP transistor 13*b* is connected with a low-side of the shunt resistor. An emitter of the other PNP transistor 14*b* is connected with a high-side of the shunt resistor. A collector and a base of the PNP transistor 13*b* are connected with the constant current circuit 15, and a collector of the PNP transistor 14*b* is connected with a collector and a base of an NPN transistor 29. A base of the NPN transistor 29 and that of the NPN transistor 30 are connected with each other. A collector of the NPN transistor 30 is connected with a constant current circuit 16, to which an electric potential that is stepped up from the power supply voltage VB by the step up circuit is applied. A connection point between the collector of the NPN transistor 30 and the constant current circuit. 16 is connected with the gate of the Nch type MOS transistor 7*b*. By switching on and off the drive transistor 17, the electric potential stepped up from the power supply voltage VB is applied to the gate of the Nch type MOS transistor 7*b*.

In a normal state of the above configured squib drive circuit 100, the drive transistor 17 is in ON, and thus, the Nch type MOS transistor 7*b* is in OFF, and a current does not flow toward the squib resistor 1. In timing for airbags to inflate following vehicle collision detection or the like, the drive transistor 17 is switched off, and the gate of the Nch type MOS transistors 7*b* is subjected to a voltage greater than or equal to a threshold voltage VT. Thereby, the Nch type MOS transistor 7*b* is switched on, and the current is allowed to flow toward the squib resistor 1. Then, the current flowing toward the squib resistor 1 is converted into a voltage by the shunt resistor 3. When the currents flowing through the PNP transistors 13*b*, 14*b* are changed due to a change in voltage drop across the shunt resistor 3, the currents flowing through the NPN transistors 29, 30 are changed in accordance with the change, so that gate electric potential of the Nch type MOS transistor 7*b* is controlled, and the source-drain current of the Nch type MOS transistors 7*b* is controlled. Through the above-described operation, the constant current control is performed so that the current flowing toward the squib resistor 1 is maintained constant.

Figure 14:
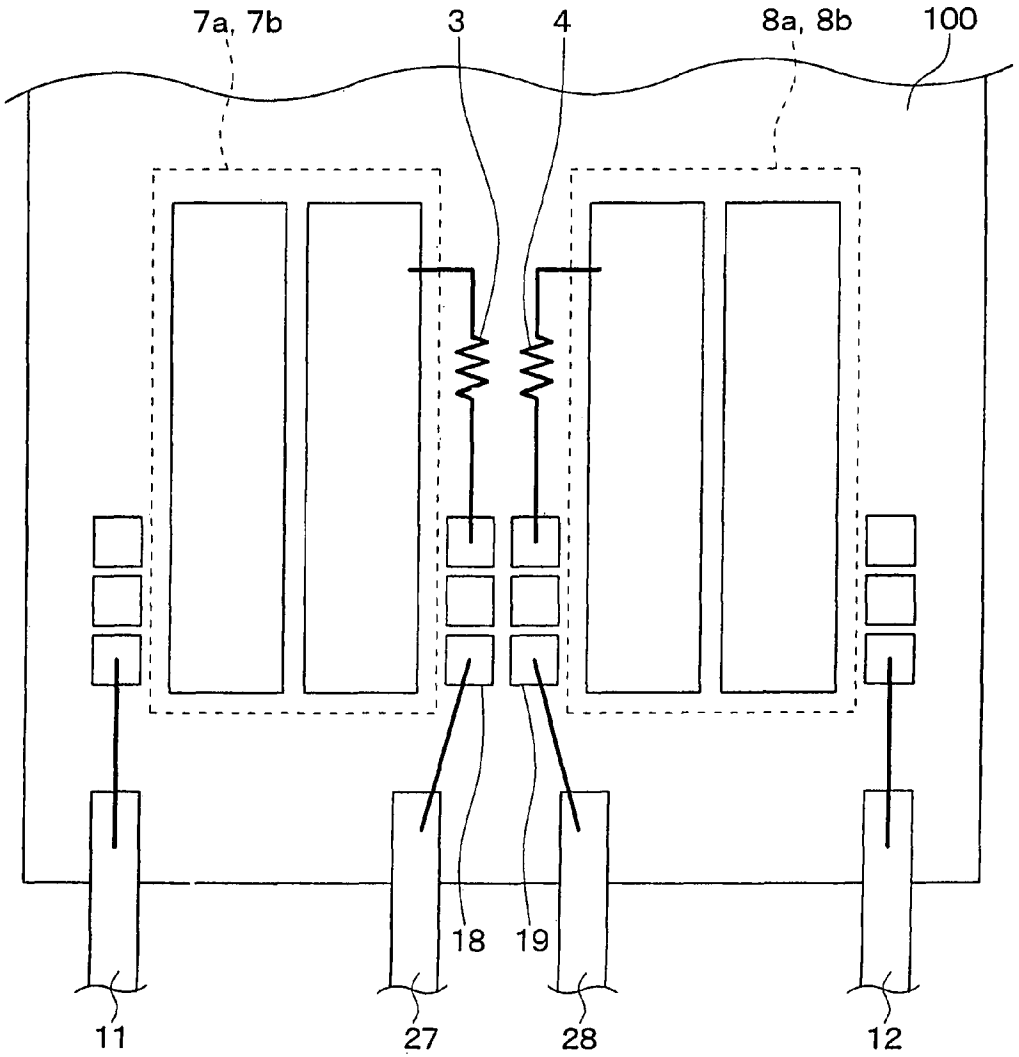
FIG. 14 is a diagram illustrating a layout of the squib drive circuit illustrated in FIGS. 10, 11.

In the squib drive circuits 100 shown in FIGS. 10 and 11, the Pch type MOS transistors 7*a*, 8*a* or the Nch type MOS transistor 7*b*, 8*b* are connected with the power supply terminals 27, 28 via the shunt resistors 3, 4, respectively. Because of the above configurations, the squib drive circuits 100 have the following layout. As shown in FIG. 14, a group of elements including the shunt resistors 3, 4 and pads 18, 19 is located between the Pch type MOS transistors 7*a* and 8*a* or between the Nch type MOS transistors 7*b* and 8*b*. The shunt resistors 3, 4 are respectively connected with the power supply terminals 27, 28 via the pads 18, 19. In FIG. 14, the shunt resistors 3, 4 are illustrated as resistors. Alternatively, the shunt resistors 3, 4 may be merely wiring resistances provided by parts of a wiring pattern. A layout of the first and second drive circuits 5, 6, which is not shown in FIG. 14, may be such that the first and second drive circuits 5, 6 are located adjacent to the Pch type MOS transistor 7*a*, 8*a* or the Nch type MOS transistors 7*b*, 8*b* of a corresponding circuit system.

Recently, an semiconductor switching element, such as a Pch type MOS transistor 7*a*, 8*a* and an Nch type MOS transistor 7*b*, 8*b*, can be downsized for reduction of an on resistance or for improvement of ESD immunity. A heat value per unit area can be increasing accordingly. Thus, there arises a difficulty; for example, since the shunt resistors 3, 4 in the above-described layout are easy to receive heat, the shunt resistors 3, 4 increase in temperature, and the temperature increase may results in the accuracy reduction of constant current control, the fracture life reduction of the shunt resistors 3, 4, the fusing of the shunt resistors 3, 4 or the like.

Taking into account the above difficulty, the layout shown in FIG. 14 may be modified in the following way: the shunt resistors 3, 4 are placed outward of a region containing the Pch type MOS transistors 7*a*, 8*a* or the Nch type MOS transistors 7*b*, 8*b*. According to the above modified layout, the shunt resistors 3, 4 can be placed so as to be distant from the Pch type MOS transistors 7*a*, 8*a* or the Nch type MOS transistors 7*b*, 8*b*. It is thus possible to suppress a temperature increase of the shunt resistors 3, 4.

However, the pads 18 and 19 become distant from each other, and the power supply terminals 27, 28 connected with the pads 18, 19 are difficult to be integrated in one common terminal. The number of terminals cannot be reduced.

Although explanation is given above on using two squib resistors 1, 2 in the above comparison examples of one embodiment, the number of squib resistors is not limited to two. For example, the number of squib resistors may be more than 2. In such a case, at least two circuit systems may share a common power supply terminal.

In view of the above and other difficulties associated with the comparison examples of one embodiment, there will be described below exemplary embodiments.

First Exemplary Embodiment

A first exemplary embodiment is described below.

Figure 1:
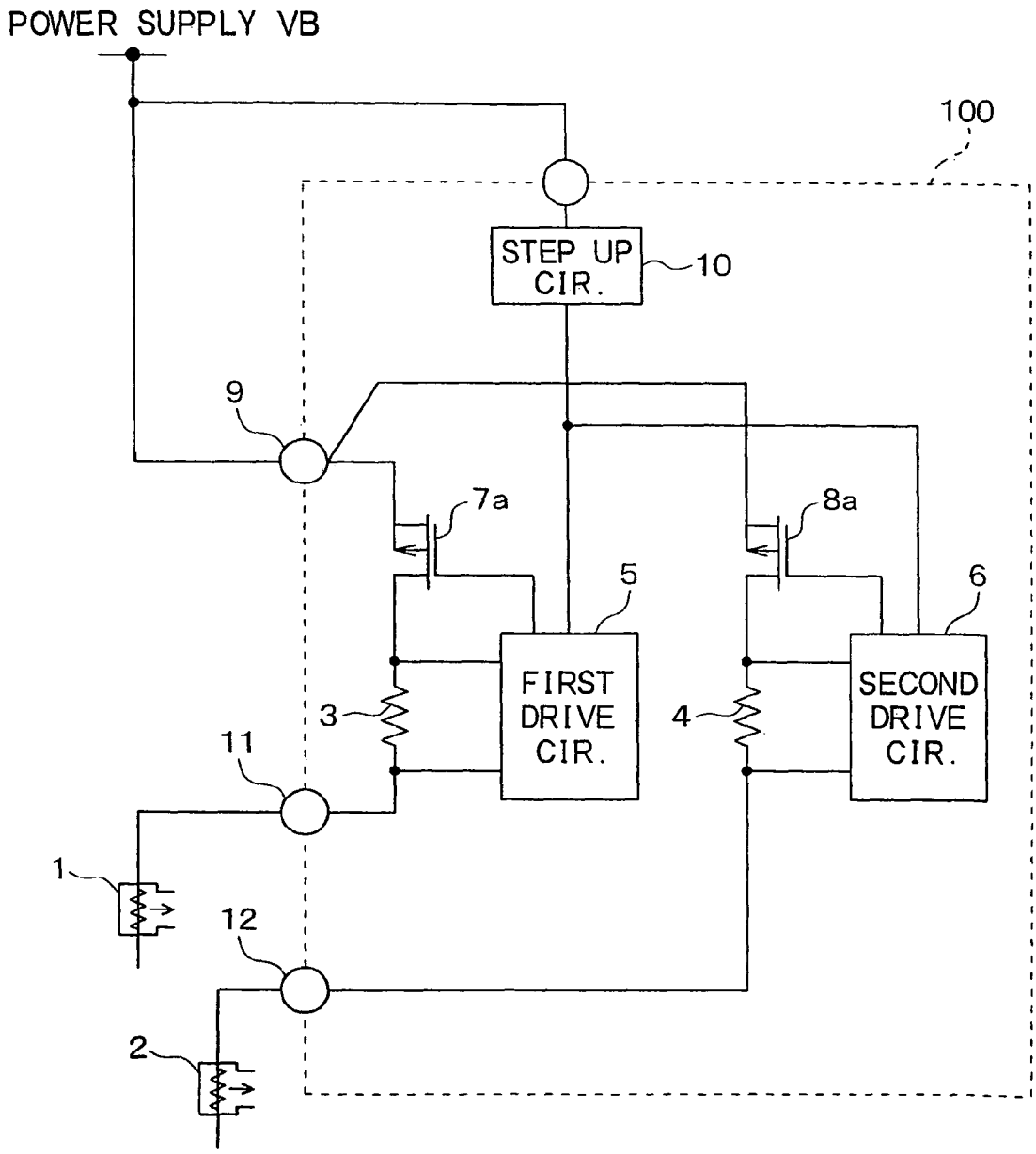
FIG. 1 is a block diagram illustrating a squib drive circuit according to a first exemplary embodiment.
Figure 2:
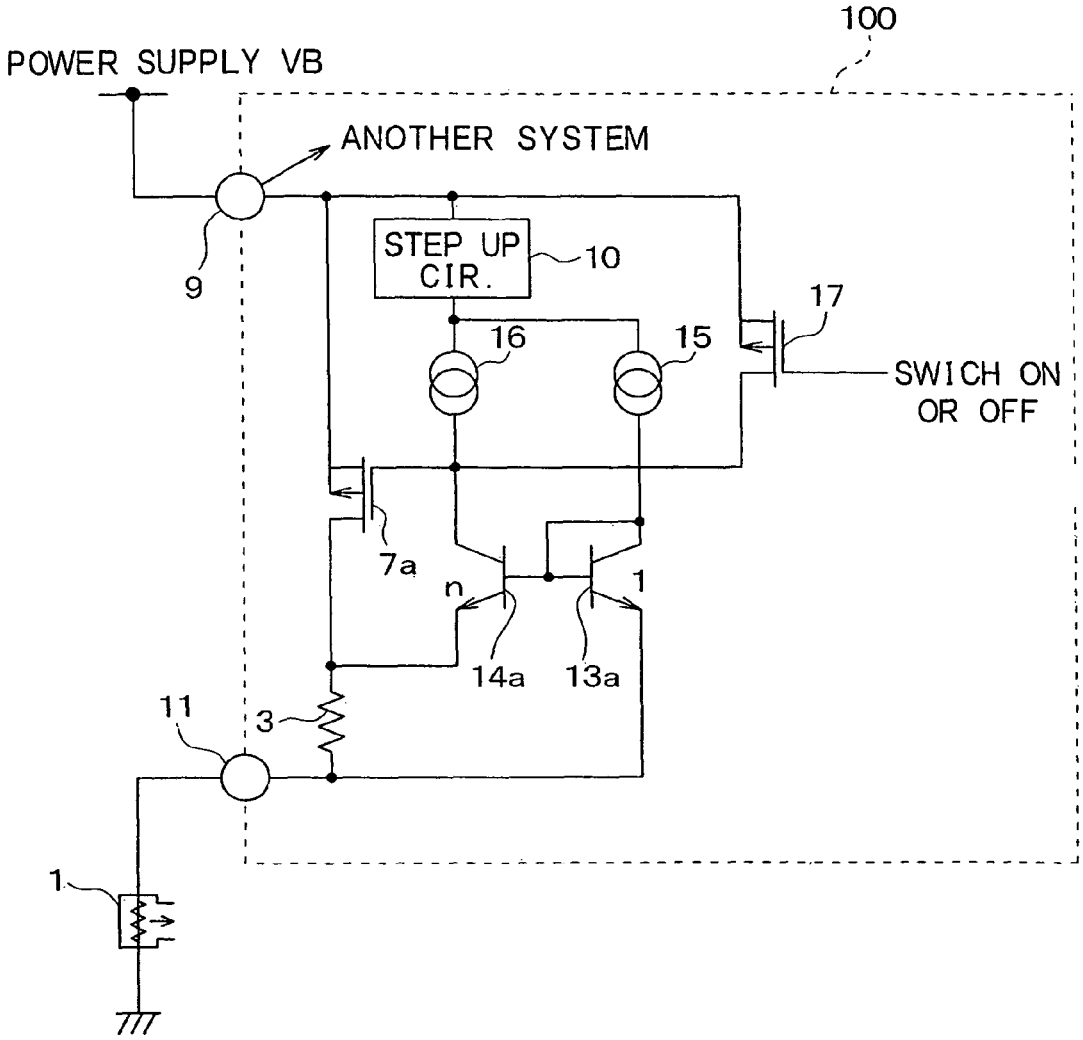
FIG. 2 is a diagram illustrating a circuit configuration of the squib drive circuit illustrated in FIG. 1.
Figure 3:
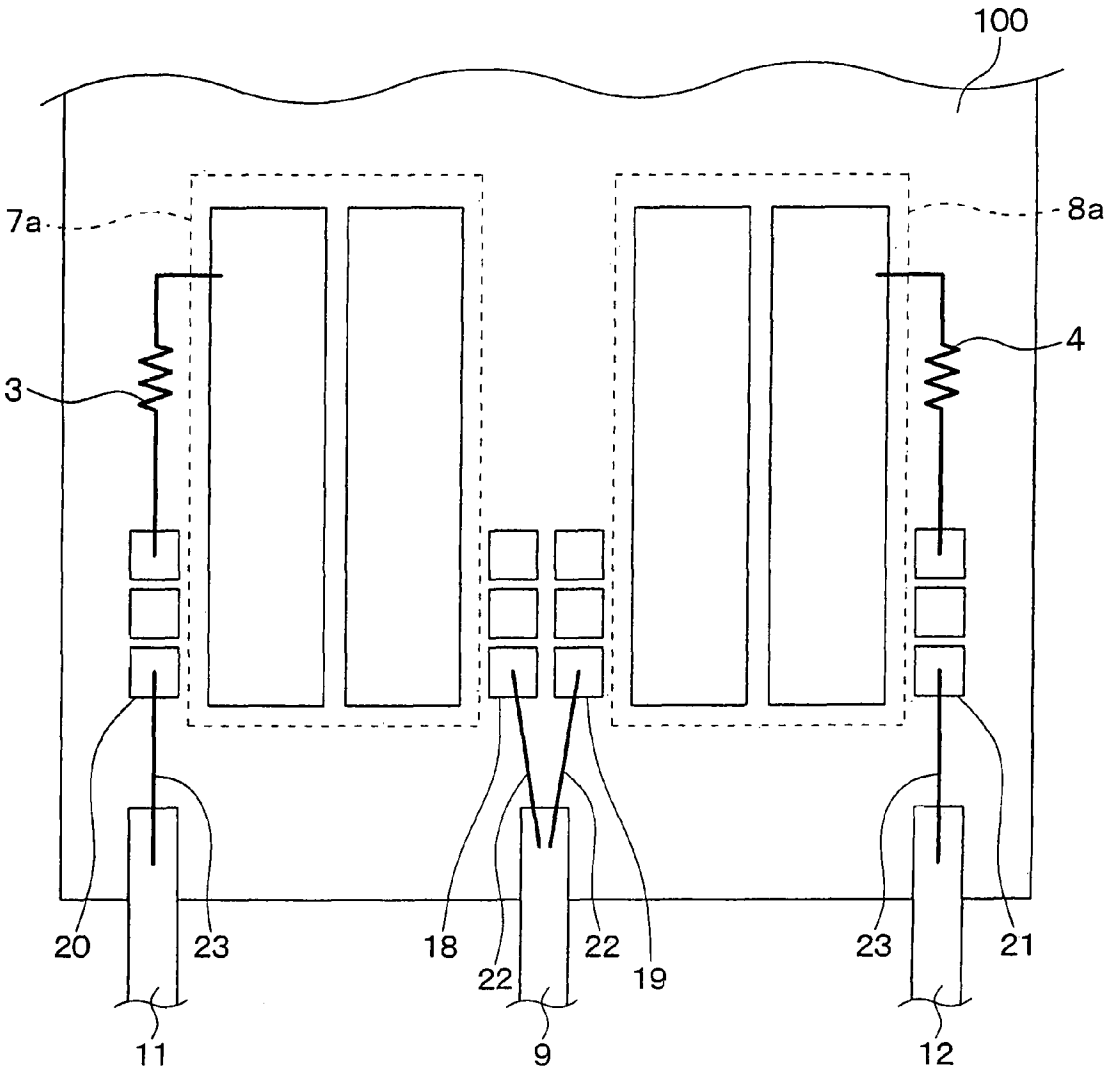
FIG. 3 is a diagram illustrating a layout of the squib drive circuit illustrated in FIG. 1.

FIG. 1 is a block diagram illustrating a squib drive circuit 100 according to a first exemplary embodiment. In the present embodiment, a Pch type MOS transistor 7*a* and another Pch type MOS transistor 8*a* are respectively used as a first semiconductor output switching element and a second semiconductor output switching element that function as high-side switches. FIG. 2 illustrates a specific circuit configuration of the squib drive circuit 100 illustrated in FIG. 1. It should be noted that, among multiple circuit systems of the squib drive circuit 100, only a circuit system for driving a squib resistor 1 is shown in FIG. 2. Another circuit system of the squib drive circuit 100 may have a circuit configuration similar to that shown in FIG. 2. FIG. 3 illustrates a layout of the squib drive circuit 100 illustrated in FIG. 1. Referring to FIG. 1 to 3, explanation is given below on the squib drive circuit 100.

The squib drive circuit 100 performs constant current control by converting currents flowing toward squib resistors 1, 2 into voltages by using shunt resistors 3, 4, transferring the voltages to first and second drive circuits 5, 6, and feedback-controlling gate voltages of the Pch type MOS transistors. The squib resistors 1, 2 may be explosive devices for airbags of a vehicle to inflate, and may be placed as corresponding to the airbags equipped in various parts of the vehicle. The squib resistors 1, 2 can act as firsthand second external load, respectively.

In the squib drive circuit 100, the Pch type MOS transistors 7*a*, 8*a* are used as first and second semiconductor switching elements that function as high-side switches. The shunt resistors 3, 4 are arranged on a low side more than the Pch type MOS transistors 7*a*, 8*a*. Drains of the Pch type MOS transistors 7*a*, 8*a* are connected with one power supply terminal 9, which is common to the Pch type MOS transistors 7*a*, 8*a*. A step up circuit 10 steps up a power source Voltage VB, and an electric potential stepped up by the step up circuit 10 is applied to the first and second drive circuits 5, 6. The shunt resistors 3, 4 are respectively connected with the squib resistors 1, 2 via output terminals 11, 12. Because of the above configuration, voltage drops across the shunt resistors 3, 4 are respectively inputted to the first and second drive circuits 5, 6, and accordingly, the gate potentials of the Pch type MOS transistors 7*a*, 8*a* are controlled, and the currents flowing toward the squib resistors 1, 2 are controlled.

More specifically, as shown in FIG. 2, bases of two NPN transistors 13*a*, 14*a* are connected with each other so as to establish a current-mirror connection whose current mirror ratio is set to 1:n. An emitter of one NPN transistors 13*a* is connected with a low-side of the shunt resistor 3. An emitter of the other NPN transistor 14*a* is connected with a high-side of the shunt resistor 3. Collectors of the NPN transistors 13*a*, 14*a* are respectively connected with the constant current circuits 15, 16. Each of the constant current circuits 15, 16 creates a constant current based on the voltage that is stepped up from the power supply voltage VB by the step up circuit 10. A connection point between the collector of the NPN transistor 14*a* and the constant current circuit 16 is connected with the gate of the Pch type MOS transistor 7*a*. By switching on and off a drive transistor 17, the power supply voltage VB is applied to the gate of the Pch type MOS transistor 7*a*. The squib drive circuit 100 employs a Pch type MOS transistor as the drive transistor 17.

In a normal state of the above-configured squib drive circuit 100, the drive transistor 17 is in ON, and thus, the Pch type MOS transistors 7*a*, 8*a* are in OFF, and currents do not flow toward the squib resistors 1, 2. In timing of airbag inflation following vehicle collision detection or the like, the drive transistor 17 is switched on and the gates of the Pch type MOS transistors 7*a*, 8*a* are subjected to voltages lower than "the power supply voltage VB minus a threshold voltage VT". Thereby, the Pch type MOS transistors 7*a*, 8*a* are switched on, and currents are allowed to flow through the squib resistors 1, 2.

Since the step up circuit 10 steps up the power supply voltage VB by a predetermined voltage and creates the stepped up electric potential, even if an electric potential of the output terminal 11 or 12 becomes as high as the power supply voltage VB, the constant current circuits 15, 16 can create constant currents supplied to the NPN transistors 13*a*, 14*a*. Then, the currents flowing toward the squib resistors 1, 2 are converted into voltages by the shunt resistors 3, 4. When the currents flowing through the NPN transistors 13*a*, 14*a* are changed due to a change in voltage drop across the shunt resistors 3, 4, the gate electric potentials of the Pch type MOS transistors 7*a*, 8*a* are controlled in accordance with the change, and the source-drain currents of the Pch type MOS transistors 7*a*, 8*a* are controlled. Accordingly, the currents flowing through the NPN transistors 13*a*, 14*a* are changed, and the constant currents created by the constant current circuits 15, 16 are changed so that the change of the currents flowing through the NPN transistors 13*a*, 14*a* are adjusted and compensated. Through the above-described operation, the constant current control is performed so that the currents flowing toward the squib resistors 1, 2 become constant.

In the above-configured squib drive circuit 100, the shunt resistors 3, 4 are respectively connected with the output terminals 11, 12. The power supply terminal 9 of the squib drive circuit 100 is one common terminal. Further, the shunt resistors 3, 4 are connected not between the power supply terminal 9 and the Pch type MOS transistors 7*a*, 8*a* but between the Pch type MOS transistors 7*a*, 8*a* and the output terminals 11, 12.

The squib drive circuit 100 of the present embodiment has the following layout. As shown in FIG. 3, the Pch type MOS transistor 7*a* of one circuit system and the Pch type MOS transistor 8*a* of another circuit system are placed adjacent to each other in the same chip. Pads 18, 19, to which the power supply voltage VB are applied, are placed between the Pch type MOS transistors 7*a* and 8*a*. Pads 20, 21, which are connected with the shunt resistors 3, 4, are placed outward of a region containing the Pch type MOS transistors 7*a*, 8*a*. The pads 18, 19 are electrically connected with the common one power supply terminal 9 by using a wiring 22 such as wire bonding and the like. The pads 20, 21 are respectively and electrically connected with the output terminals 11, 12 by using a wiring 23 such wire bonding and the like.

According to the above layout, it is possible to connect the pads 18, 19 to the common one power supply terminal 9, and it is possible to place the shunt resistors 3, 4 not at a place between the Pch type MOS transistors 7*a* and 8*a* but at a place located outward of the region containing the Pch type MOS transistors 7*a* and 8*a*. Therefore, even when the Pch type MOS transistors 7*a*, 8*a* increases in temperature, an increase in temperature of the shunt resistors 3, 4 due to an increase in temperature of the Pch type MOS transistors 7*a*, 8*a* can be suppressed. In particular, when the Pch type MOS transistor 7*a* or 8*a* of one circuit system is driven, the shunt resistor 3 or 4 of another circuit system is distant from the Pch type MOS transistors 7*a*, 8*a* that is driven, and thus, it is possible to further suppress a temperature increase of the shunt resistor 3 or 4. Moreover, since the power supply terminal 9 is provided as one common terminal, it is possible to reduce the number of terminals.

The emitter of the NPN transistor 13*a*, 14*a* may receive the ESD surge when electrostatic discharge (ESD) surge is inputted via the output terminal 11, 12 or the like. Since an emitter of an NPN transistor is typically susceptible to electrostatic breakdown, a concern arises about Zener breakdown between the emitter and the base. In view of the above concern, according to the present embodiment, when the NPN transistors 13*a* and 14*a* are integrated in one chip, elements may be formed and separated with trench isolation structure but not with junction separation. By using the trench isolation, it is possible to minimize malfunction when the ESD surge is inputted.

Second Exemplary Embodiment

A second exemplary embodiment is described below. The second exemplary embodiment is a modification of the first exemplary embodiment. In the present embodiment, Nch type MOS transistors 7*b*, 8*b* drive the squib drive circuit 100 for instance.

Figure 4:
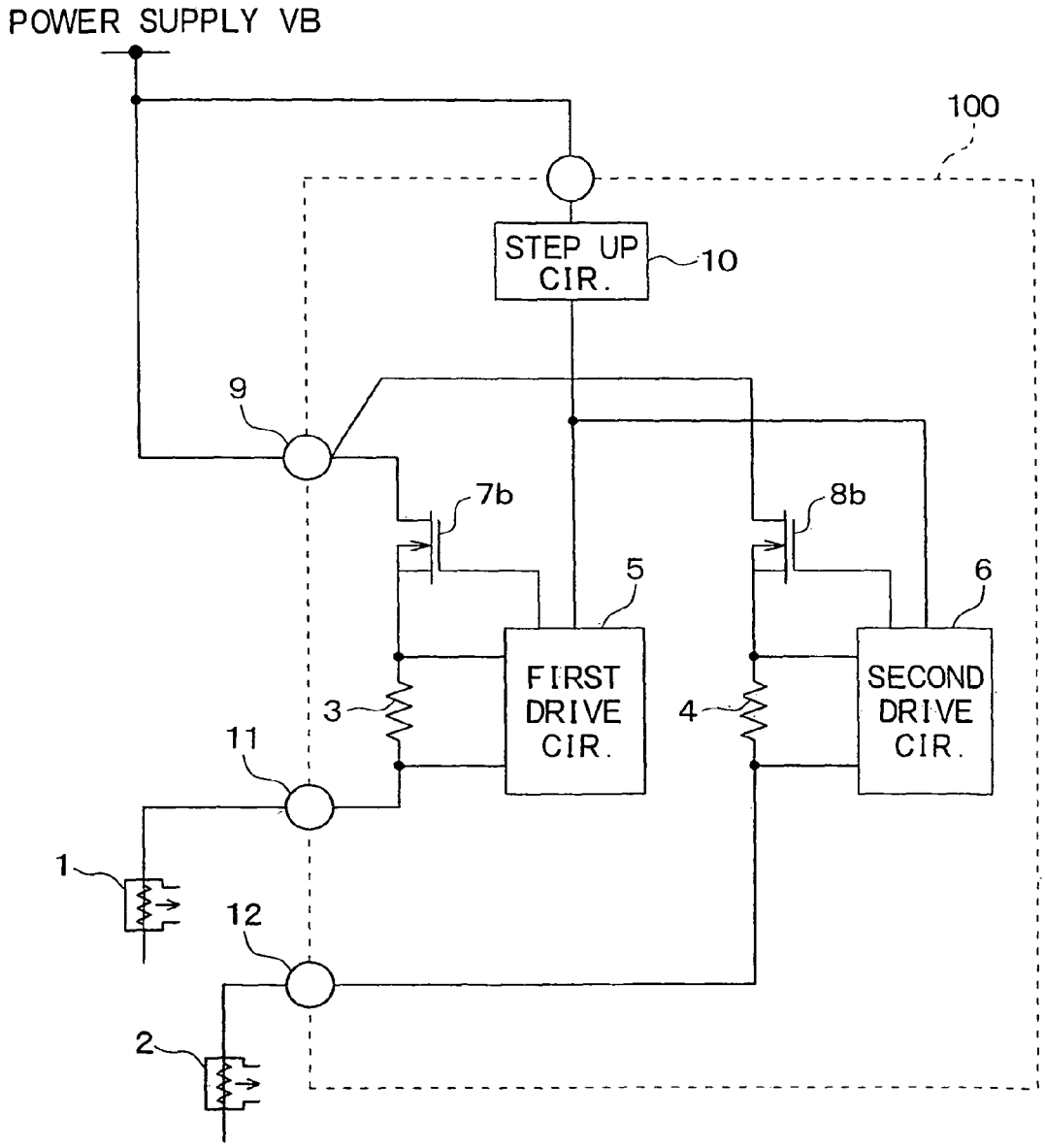
FIG. 4 is a block diagram illustrating a squib drive circuit according to a second exemplary embodiment.
Figure 5:
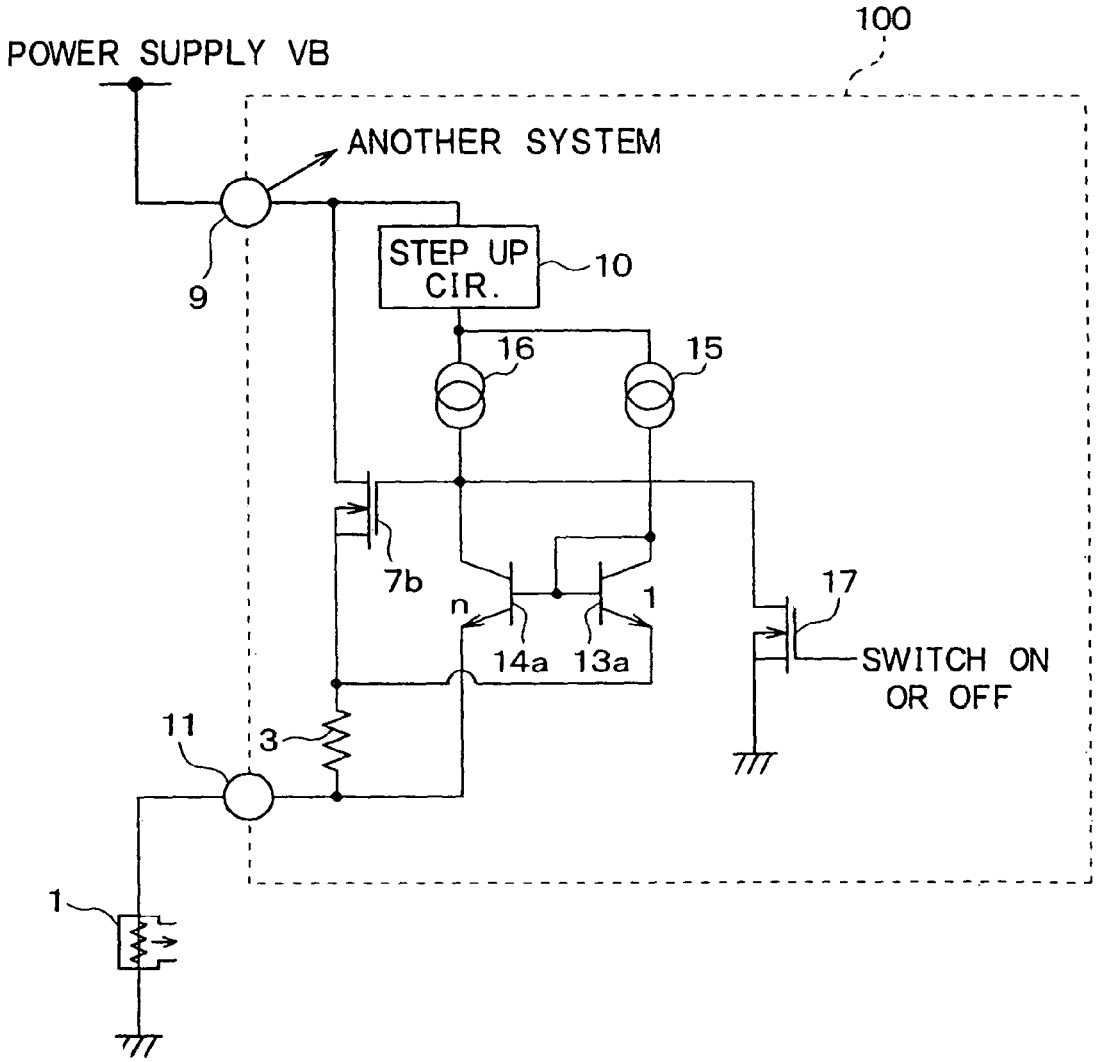
FIG. 5 is a diagram illustrating a circuit configuration of the squib drive circuit illustrated in FIG. 4.

FIG. 4 is a block diagram illustrating a squib drive circuit 100 according to the present embodiment. The Nch type MOS transistors 7*b*, 8*b* are respectively used as first and second semiconductor output switching elements, which function as high-side switches. FIG. 5 illustrates one specific circuit configuration of the squib drive circuit illustrated in FIG. 4. It should be noted that, among multiple circuit systems of the squib drive circuit 100, only a circuit system for driving a squib resistor 1 is shown in FIG. 4. Another circuit system of the squib drive circuit 100 may have a circuit configuration similar to that shown in FIG. 4. A layout shown in FIG. 3 can be used as a layout of the squib drive circuit 100 illustrated in FIG. 4. Referring to FIGS. 4 and 5, explanation is given below on the squib drive circuit 100 of the present embodiment.

As shown in FIG. 4, the Nch type MOS transistors 7*b*, 8*b* are used in place of the Pch type MOS transistors 7*a*, 8*a*. The drive transistor 17 is also an Nch type MOS transistor. The drive transistor 17 is connected between the gate of the Nch type MOS transistor 7*b*, 8*b* and GND. By controlling the gate electric potential of the drive transistor 17, the Nch type MOS transistor 7*b*, 8*b* are driven.

The NPN transistors 13*a*, 14*a* are current-mirror-connected with each other. The emitter of the NPN transistor 13*a* is connected with a high side of the shunt resistor 3, 4, and the emitter of the NPN transistor 14*a* is connected with a low side of the shunt resistor 3, 4.

In a normal state of the above configured squib drive circuit 100, the drive transistor 17 is in ON, and thus, the Nch type MOS transistors 7*b*, 8*b* are in OFF, and currents do not flow though the squib resistors 1, 2. In timing of airbag inflation following vehicle collision detection or the like, the drive transistor 17 is switched off, and voltages greater than or equal to a threshold voltage VT are applied to the gates of the Nch type MOS transistors 7*b*, 8*b*. Thereby, the Nch type MOS transistor 7*b*, 8*b* are switched on, and the currents are allowed to flow through the squib resistors 1, 2.

Since the step up circuit 10 steps up the power supply voltage VB by a predetermined voltage and creates the stepped up electric potential, even if an electric potential of the output terminal 11 or 12 becomes as high as the power supply voltage VB, the constant current circuits 15, 16 can create constant currents to be supplied to the NPN transistors 13*a*, 14*a*. Then, the currents flowing toward the squib resistors 1, 2 are converted into voltages by the shunt resistors 3, 4. When the currents flowing through the NPN transistors 13*a*, 14*a* are changed due to a change in voltage drop across the shunt resistors 3, 4, the currents flowing through the NPN transistors 29, 30 are changed, so that gate electric potentials of the Nch type MOS transistors 7*b*, 8*b* are controlled, and the source-drain currents of the Nch type MOS transistors 7*b*, 8*b* are controlled. Through the above-described operation, the constant current control is performed so that the currents flowing toward the squib resistors 1, 2 become constant.

In the above-configured squib drive circuit 100, the shunt resistors 3, 4 are respectively connected with the output terminals 11, 12. The power supply terminal 9 is one common terminal. Further, the shunt resistors 3, 4 are connected not between the power supply terminal 9 and the Pch type MOS transistors 7*b*, 8*b* but between the Pch type MOS transistors 7*b*, 8*b* and the output terminals 11, 12.

As described above, the layout of the squib drive circuit 100 of the present embodiment can be generally similar to the layout shown in FIG. 3. Accordingly, the squib drive circuit 100 of the present embodiment can have the same advantages as that of the first exemplary embodiment.

Third Exemplary Embodiment

A third exemplary embodiment is described below. The third exemplary embodiment is a modification of the first exemplary embodiment or second exemplary embodiment. In the third exemplary embodiment, the pads 18, 19 connected to the power supply terminal 9 are integrated into a common pad. A circuit configuration of the squib drive circuit 100 of the present embodiment can be the same as that of the first exemplary embodiment or the second exemplary embodiment. A difference lies in layout.

Figure 6:
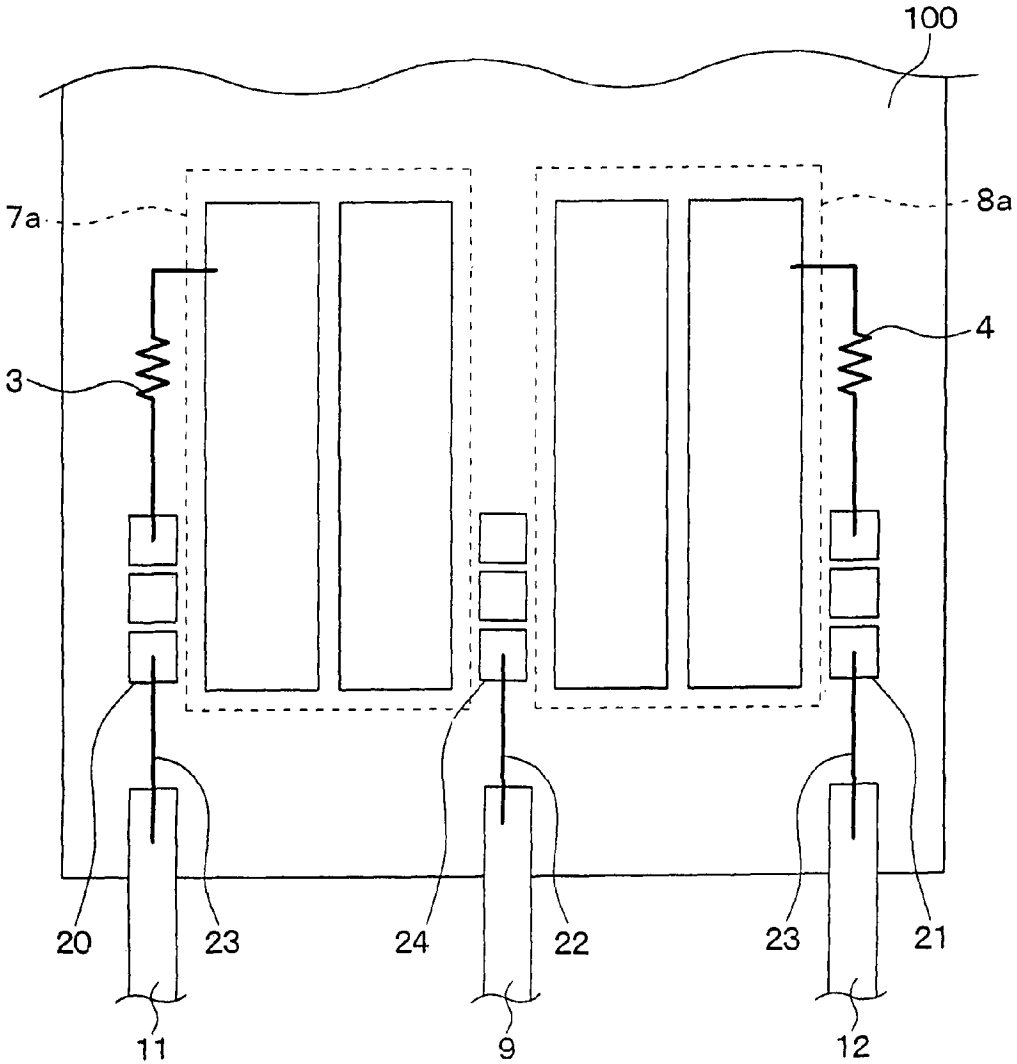
FIG. 6 is a diagram illustrating a layout of a squib drive circuit according to a third exemplary embodiment.

FIG. 6 illustrates a layout of a squib drive circuit 100 according to the present embodiment. As shown in FIG. 6, the Pch type MOS transistors 7*a*, 8*a* or the Nch type MOS transistors 7*b*, 8*b* are electrically connected with the power supply terminal via a pad 24. The pad 24 is arranged between the Pch type MOS transistors 7*a* and 8*a* or between the Nch type MOS transistors 7*b* and 8*b* while being aligned. More specifically, a pad connected with the Pch type MOS transistor 7*a* and that connected with the P type MOS transistor 8*a* are integrated into a common pad, or, a pad connected with the Nch type MOS transistor 7*b* and that connected with the N type MOS transistor 8*b* are integrated into a common pad. By using the common pad 24, it becomes possible to downsize an apparatus.

Fourth Exemplary Embodiment

A fourth exemplary embodiment is described below. The fourth exemplary embodiment is a modification of the first exemplary embodiment. For example, a squib drive circuit 100 of the present embodiment further includes a limiting resistor.

Figure 7:
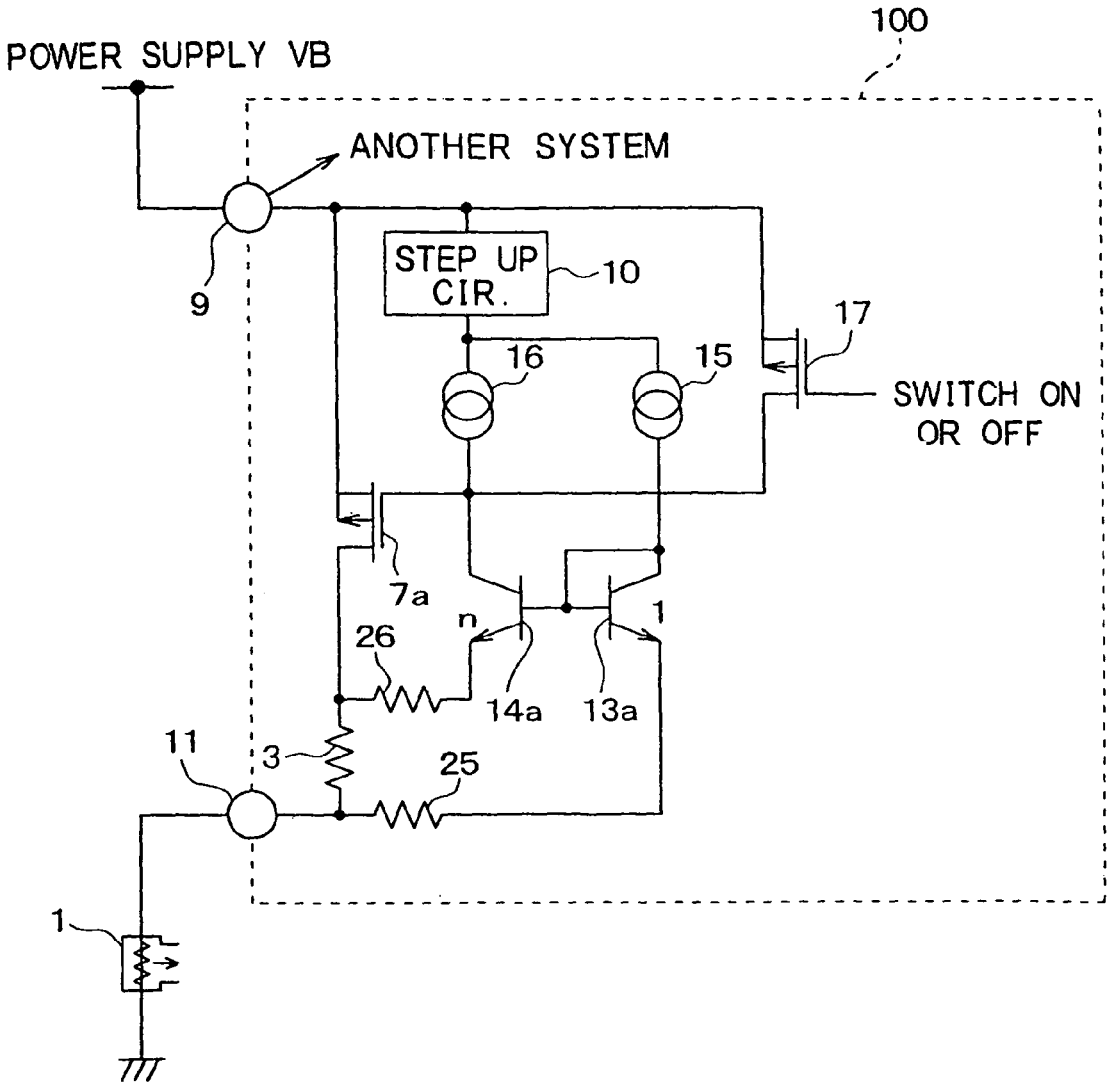
FIG. 7 is a diagram illustrating a circuit configuration of a squib drive circuit according to a fourth exemplary embodiment.

FIG. 7 is a block diagram illustrating a squib drive circuit 100 according to the present embodiment. As shown in FIG. 7, a limiting resistor 25 is connected between the NPN transistor 13*a* and the shunt resistor 3, 4, and a limiting resistor 26 is connected between the NPN transistor 14*a* and the shunt resistor 3, 4. Because of the presence of the limiting resistors 25, 26, if ESD surge is inputted via the output terminals 11, 12 or the like, a current caused by the ESD surge can be reduced by the limiting resistors 25, 26. Thus, it is possible to minimize malfunction when the ESD surge is inputted.

The squib drive circuit 100 of the present embodiment may further include a clamp circuit that clamps an upper limit of voltage inputted from the output terminal 11, 12. For example, each output terminal 11, 12 is connected with a MOS transistor via a diode, and a Zener diode is connected between a source and a base of the MOS transistor. According to the above configuration, when a predetermined voltage is applied across the Zener diode, the MOS transistor is switched on, and thus, the upper limit of the voltage inputted from the output terminal 11, 12 can be clamped; therefore, it is possible to further improve an ESD immunity.

Fifth Exemplary Embodiment

A fifth exemplary embodiment is described below.

In the present embodiment, explanation is give on an element isolation way, a structure of the NPN transistor 13*a*, 14*a* etc. of a squib drive circuit of the first exemplary embodiment. It should be noted that a basic circuit configuration of a squib drive circuit is similar between the first and fifth exemplary embodiments.

Figure 8:
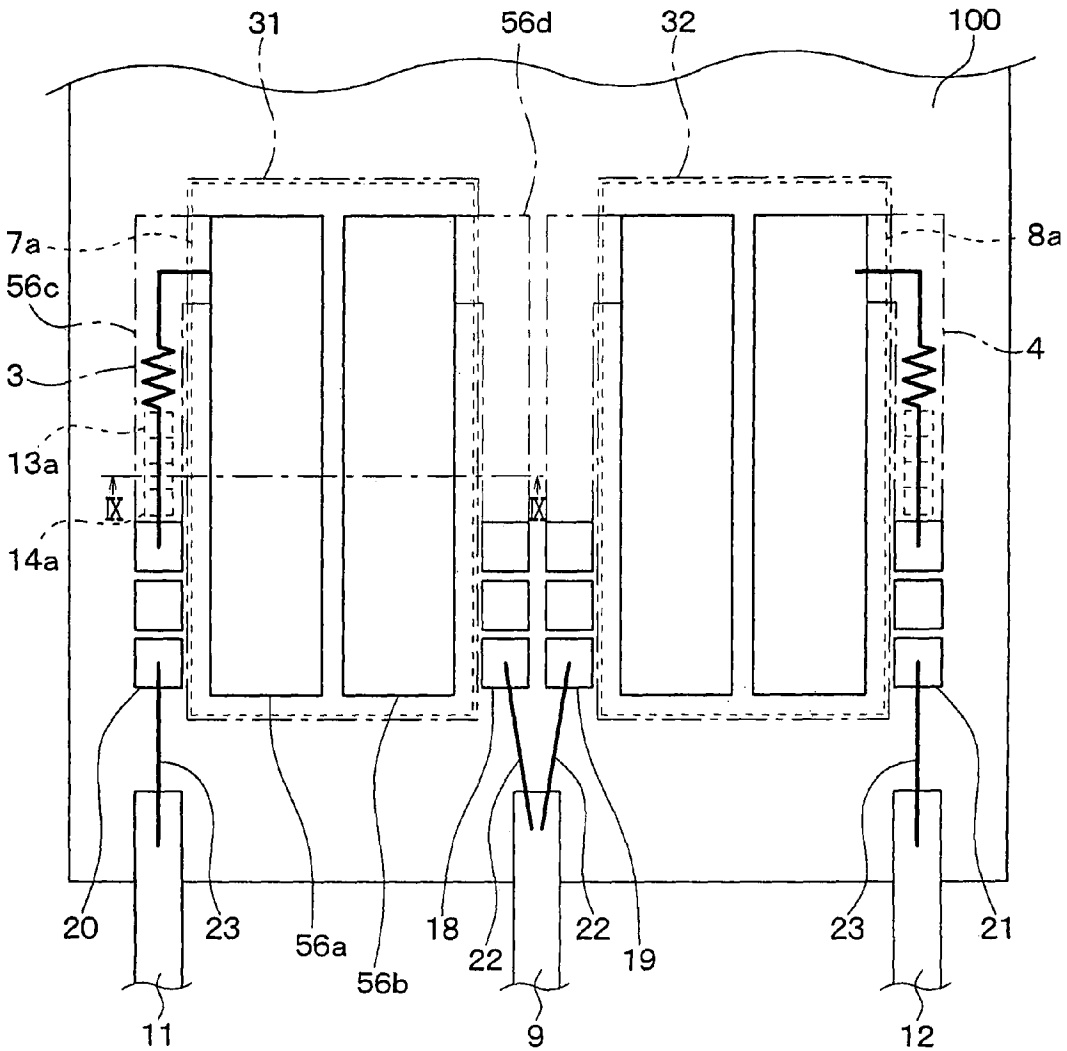
FIG. 8 is a diagram illustrating a layout of a squib drive circuit according to a fifth exemplary embodiment.
Figure 9:
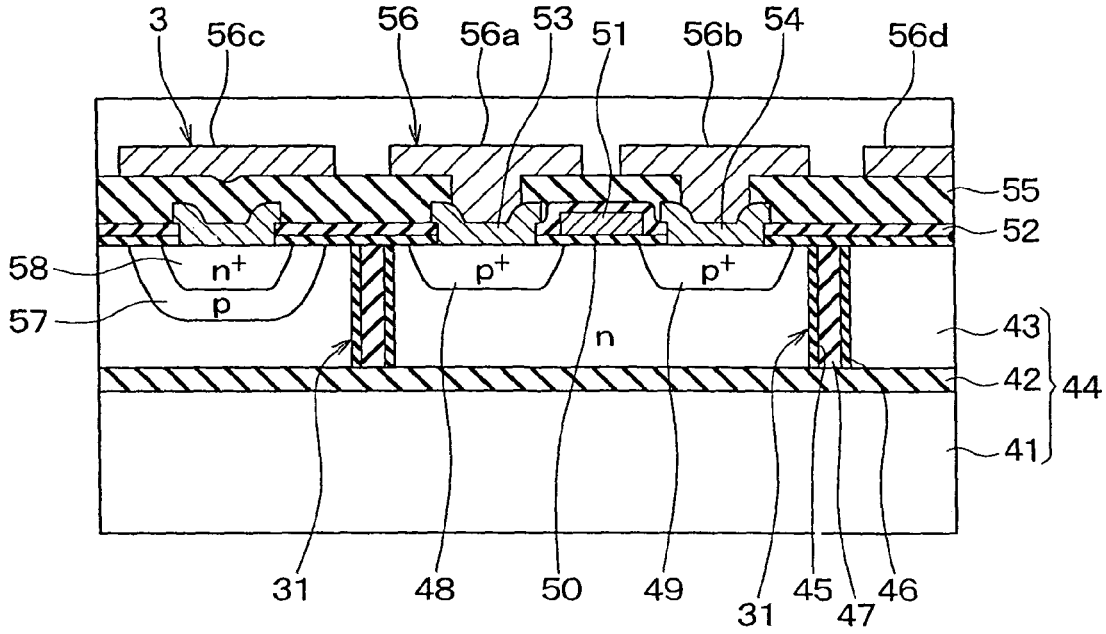
FIG. 9 is a cross sectional diagram taken along line IX-IX in FIG. 8.

FIG. 8 illustrates a layout of a squib drive circuit according to the present embodiment. FIG. 9 illustrates a cross section taken along line IX-IX in FIG. 8.

As shown in FIG. 8, trench isolation structures 31, 32 are formed so as to surround the Pch type MOS transistors 7*a*, 8*a*, respectively.

More specifically, as shown in FIG. 9, the squib drive circuit 100 is formed using a Silicon On Insulator (SOI) substrate 44 in which a buried oxide layer 42 is sandwiched between an active layer 43 and a support substrate 43*a*. The active layer 43 is formed by, for example, thinning an N type substrate. The trench isolation structure 31 is formed such that: a trench 45 is formed so as to penetrate the active layer 43 and so as to reach the buried oxide layer 42; and a side wall insulating film 46 and a filling layer 47 are placed in the trench 45. The filling layer 47 is made of, for example, polysilicon.

A $p^+$ type source region 48 and a $p^+$ type drain region 49 are formed in a surface portion of the active layer 43 so as to be spaced apart from each other. A part of the surface portion between the $p^+$ type source region 48 and the $p^+$ type drain region 49 functions as a channel region. A gate electrode 51 is formed above a surface of the channel region while a gate insulator film 50 is interposed between the gate electrode 51 and the surface of the channel region. An element region of the Pch type MOS transistor 7*a* is formed in the above arrangement. The element region is surrounded by the trench isolation structure 31. It should be noted that, although a cross section of the trench isolation structure 32 is not shown in FIG. 9, the trench isolation structure 32 and the trench isolation structure 31 may have generally identical structure.

In the present embodiment, the shunt resistor 3 is provided as a wiring resistance of a wiring. The NPN transistor 13*a*, 14*a* is located below the wiring.

For instance, as shown in FIG. 9, the Pch type MOS transistor 7*a*, 8*a* has the following structure. A source electrode 53 is electrically connected with the $p^+$ type source region 48 though a contact hole formed in the interlayer insulation film 52. A drain electrode 54 is electrically connected with a $p^+$ type drain region 49. A wiring pattern 56 is formed on an interlayer insulating film 55. The wiring pattern 56 includes a source wiring part 56*a* electrically connected with the source electrode 53 and a drain wiring part 56*b* electrically connected with the drain electrode 54. The wiring pattern 56 further includes a wiring resistance part 56*c* and a connection part 56*d*. The wiring resistance part 56*c* acts as the shunt resistor 3 and is located adjacent to the source wiring part 56*a* and the drain wiring part 56*b*. The connection part 56*d* connects the drain wiring part 56*b* and the pad 18. The NPN transistors 13*a*, 14*a* are located below the shunt resistor 3, which is provided as the wiring resistance part 56*c*.

Is should be noted that, although FIG. 9 illustrates the p type base region 57 and the p type emitter region 58, an $n^+$ type collector region etc. is formed in a part of the NPN transistor 7*a* that is located outside of the page space of FIG. 9 in a direction perpendicular to the page space. Further, although the circuit system that has the shunt resistor 4 is not shown in FIG. 9, an NPN transistor of the un-shown circuit system is also located below the shunt resistor 4.

According to the present embodiment, the NPN transistors 13*a* and 14*a* are located adjacent to each other, and an alignment direction of the NPN transistors 13*a* and 14*a* is parallel to the Pch type MOS transistor 7*a*, which can become a relatively large heat source. The NPN transistors 13*a* and 14*a* are equal to each other in distance from the Pch type MOS transistor 7*a*.

Since the trench isolation structures 31, 32 respectively surround the Pch type MOS transistors 7*a*, 8*a* as seen above, it is possible to suppress conduction of the heat generated by each Pch type MOS transistor 7*a*, 8*a* to its surrounding region including a region of another circuit system, compared to the use of PN isolation or the like. Further, it is possible to suppress conduction of heat in the surrounding region to the Pch type MOS transistor 7*a*, 8*a*.

Typically, when the squib drive circuit 100 is in operation, the Pch type MOS transistor 7*a*, 8*a* can become a major heat source. If the heat were conducted to the surrounding region, the heat would cause an error; for example, the heat could influence operation of the NPN transistor 13*a*, 14*a* in some cases. Further, if the Pch type MOS transistor 7*a*, 8*a* were subjected to the heat from another circuit system, the heat would influence operation of the Pch type MOS transistor 7*a*, 8*a* in some cases. In view of the above-described possibility, in the present embodiment, the Pch type MOS transistor 7*a*, 8*a* are surrounded by the trench isolation structures 31, 32, and is thermally isolated from another region. Thus, the above-described error can be prevented. In addition, the use of the trench isolation structure 31, 32 reduces a leak current more efficiently than the use of the PN isolation. Further, the trench isolation structure 31, 32 can be placed closer to the Pch type MOS transistor 7*a*, 8*a* acting as the heat source compared to the PN isolation, and thus, it is possible reduce an non-active area.

Since the NPN transistors 13*a*, 14*a* are located below the shunt resistor 3, the shunt resistor 3 and the NPN transistors 13*a* and 14*a* are equal to each other in distance from a heat generation source of the first and second semiconductor switching elements. Thus, it is possible to reduce a temperature difference between the shunt resistor 3 and the first and second NPN transistors. In addition, the shunt resistor 3 is formed using the wiring resistance part 56*c* made of metal such as aluminum and the like, the shunt resistor 3 has a high thermal conductivity compared to the NPN transistor 13*a*, 14*a*, which has diffused layers. Because of the above thermal characteristics, an arrangement of the NPN transistor 13*a*, 14*a* located below the shunt resistor 3 with a higher thermal conductivity enables efficient heat transfer between the shunt resistor 3 and the NPN transistor 13*a*, 14*a*. Thus, a temperature difference between the shunt resistor 3 and the NPN transistor 13*a*, 14*a* can be minimized. Therefore, even when the shunt resistor 3 or the NPN transistor 13*a*, 14*a* are arranged in the vicinity of the Pch type MOS transistor 7*a*, 8*a* acting as a heat source, such an arrangement does not cause a characteristic change. In particular, since the use of the trench isolation structure 31, 32 can reduce thermal conduction, the above-described advantage become more effective as the shunt resistor 3 or the NPN transistor 13*a*, 14*a* are arranged closer to the vicinity of the Pch type MOS transistor 7*a*, 8*a*.

Further, since the NPN transistors 13*a* and 14*a* are located so as to be equal to each other in distance from the Pch type MOS transistor 7*a*, it is possible to equally transfer the heat of the Pch type MOS transistor 7*a* to the NPN transistors 13*a* and 14*a*. Thus, it is possible to suppress a temperature-inducible characteristic change of the current-mirror-connected NPN transistors 13*a* and 14*a*, and it is possible to prevent a pair from being impaired.

According to the above example, the squib drive circuit 100 has such structures that: (i) the trench isolation structure 31, 32 is, employed as isolation structure; (ii) the NPN transistor 13*a*, 14*a* is placed below the shunt resistor 3, 4; and (iii) the NPN transistors 13*a* and 14*a* are placed so as to be equal in distance from the Pch type MOS transistor 7*a*. Alternatively, the squib drive circuit 100 may not employ all of the above-described structures but may employ one or more of the structures, so that the squib drive circuit 100 has advantages corresponding to the employed structures.

(Modifications)

The above embodiments can be modified in various ways, examples of which are described below.

In the above embodiments, the shunt resistors 3, 4 are illustrated as resistors in the drawings. Alternatively, the shunt resistor 3, 4 may be merely a wiring resistance in a wiring pattern.

In the above embodiments, a low side of the squib resistor 1, 2 is grounded. Alternatively, a low side of the squib resistor 1, 2 may not be directly grounded but may be grounded via a semiconductor switching element, which is a MOS transistor for instance. According to the alternative configuration, the semiconductor switching element is turned off in a normal state, and is continuously turned on to allow the current to flow through the squib resistors 1, 2.

In the first exemplary embodiment, the squib drive circuit 100 includes the first and second drive circuits 5, 6 each having a circuit configuration shown in FIG. 2. In the second exemplary embodiment, the squib drive circuits includes the first and second drive circuits 5, 6 each having a circuit configuration shown in FIG. 5. However, the circuit configuration of the first and second drive circuits 5, 6 is not limited to the above examples. For example, although the drive transistor 17 is connected with GND in FIG. 5, the drive transistor 17 may be connected with the output terminal 11.

In the above embodiments, the number of squib resistors 1, 2 is two as one example. However, the number of squib resistors is not limited to two. For example, more than two squib resistors may be used. In such a case, at least two circuit systems may share a common power supply terminal.

In the above embodiments, the squib drive circuit 100 for supplying constant currents to loads such as squib resistors 1, 2 is explained as an example of a constant current control circuit having built-in shunt resistors 3, 4. Alternatively, the constant current control circuit may be another type of circuit that detects a constant current flowing toward a load and controls the constant current.

While the invention has been described above with reference to various embodiments thereof, it is to be understood that the invention is not limited to the above described embodiments and constructions. The invention is intended to cover various modifications and equivalent arrangements. In addition, while the various combinations and configurations described above are contemplated as embodying the invention, other combinations and configurations, including more, less or only a single element, are also contemplated as being within the scope of embodiments.

What is claimed is:

1. A constant current control circuit coupled with a first external load and a second external load, the constant current control circuit comprising;

a power supply terminal that a power supply voltage is applied to;

a first semiconductor switching element that is connected with the power supply terminal and controls a first constant current, the first constant current flowing toward the first external load based on the power supply voltage;

a second semiconductor switching element that is connected with the power supply terminal and controls a second constant current, the second constant current flowing toward the second external load based on the power supply voltage;

a first output terminal that is connected with the first external load;

a second output terminal that is connected with the second external load;

a first shunt resistor that is connected between the first external load and the first semiconductor switching element, and detects the first constant current;

a second shunt resistor that is connected between the second external load and the second semiconductor switching element, and detects the second constant current;

a step up circuit that steps up the power supply voltage by a predetermined voltage;

a first drive circuit that is driven based on the stepped up power supply voltage, and controls the first semiconductor switching element based on the first constant current detected by the first shunt resistor;

a second drive, circuit that is driven based on the stepped up power supply voltage, and controls the second semiconductor switching element based on the second constant current detected by the second shunt resistor;

a first pad that is connected with the first semiconductor switching element; and a second pad that is connected with the second semiconductor switching element, wherein:

the first semiconductor switching element and the second semiconductor switching element are arranged in a same chip and located adjacent to each other in the chip;

the first and second pads are located between the first semiconductor switching element and the second semiconductor switching element;

the first and second pads are electrically connected with the power supply terminal, which is a single terminal common to the first and second pads; and the first and second shunt resistors are located outward of a region containing the first and second semiconductor switching elements.

2. The constant current control circuit according to claim 1, wherein:

the first semiconductor switching element is a first Pch type MOS transistor;

the first drive circuit includes:

a first constant current circuit that creates a third constant current based on the stepped up power supply voltage;

a second constant current circuit that creates a fourth constant current based on the stepped up power supply voltage;

a first NPN transistor, a base and a collector of the first NPN transistor being connected with the first constant current circuit;

a second NPN transistor, a collector of the second NPN transistor being connected with the second constant current circuit, a base of the second NPN transistor and the base of the first NPN transistor being connected with each other so as to establish a first current mirror connection; and a first drive transistor that controls a base voltage of the first Pch type MOS transistor, wherein a connection point between the second constant current circuit and the collector of the second NPN transistor is connected with the gate of the first Pch type MOS transistor, wherein an emitter of the first NPN transistor is connected with a low side of the first shunt resistor, wherein an emitter of the second NPN transistor is connected with a high side of the first shunt resistor;

the second semiconductor switching element is a second Pch type MOS transistor; and the second drive circuit includes:

a third constant current circuit that creates a fifth constant current based on the stepped up power supply voltage;

a fourth constant current circuit that creates a sixth constant current based on the stepped up power supply voltage;

a third NPN transistor, a base and a collector of the third NPN transistor being connected with the third constant current circuit;

a fourth NPN transistor, a collector of the fourth NPN transistor being connected with the fourth constant current circuit, a base of the fourth NPN transistor and the base of the third NPN transistor being connected with each other so as to establish a second current mirror connection; and a second drive transistor that controls a base voltage of the second Pch type MOS transistor, wherein a connection point between the fourth constant current circuit and the collector of the fourth NPN transistor is connected with the gate of the second Pch type MOS transistor, wherein an emitter of the third NPN transistor is connected with a low side of the second shunt resistor, wherein an emitter of the fourth NPN transistor is connected with a high side of the second shunt resistor.

3. The constant current control circuit according to claim 1, the first semiconductor switching element is a first Nch type MOS transistor;

the first drive circuit includes:

a first constant current circuit that creates a third constant current based on the stepped up power supply voltage;

a second constant current circuit that creates a fourth constant current based on the stepped up power supply voltage;

a first NPN transistor, a base and a collector of the first NPN transistor being connected with the first constant current circuit;

a second NPN transistor, a collector of the second NPN transistor being connected with the second constant current circuit, a base of the second NPN transistor and the base of the first NPN transistor being connected with each other so as to establish a first current mirror connection; and a first drive transistor that controls a base voltage of the first Nch type MOS transistor, wherein a connection point between the second constant current circuit and the collector of the second NPN transistor is connected with the gate of the first Nch type MOS transistor, wherein an emitter of the first NPN transistor is connected with a high side of the first shunt resistor, wherein an emitter of the second NPN transistor is connected with a low side of the first shunt resistor;

the second semiconductor switching element is a second Nch type MOS transistor; and the second drive circuit includes:

a third constant current circuit that creates a fifth constant current based on the stepped up power supply voltage;

a fourth constant current circuit that creates a sixth constant current based on the stepped up power supply voltage;

a third NPN transistor, a base and a collector of the third NPN transistor being connected with the third constant current circuit;

a fourth NPN transistor, a collector of the fourth NPN transistor being connected with the fourth constant current circuit, a base of the fourth NPN transistor and the base of the third NPN transistor being connected with each other so as to establish a second current mirror connection; and a second drive transistor that controls a base voltage of the second Nch type MOS transistor, wherein a connection point between the fourth constant current circuit and the collector of the fourth NPN transistor is connected with the gate of the second Pch type MOS transistor, wherein an emitter of the third NPN transistor is connected with a high side of the second shunt resistor, wherein an emitter of the fourth NPN transistor is connected with a low side of the second shunt resistor.

4. The constant current control circuit according to claim 2, further comprising:

a first limiting resistor that is connected between the first shunt resistor and the first NPN transistor, the first liming resistor limiting a current flowing toward the first NPN transistor;

a second limiting resistor that is connected between the first shunt resistor and the second NPN transistor, the second liming resistor limiting a current flowing toward the second NPN transistor;

a third limiting resistor that is connected between the second shunt resistor and the third NPN transistor, the third liming resistor limiting a current flowing toward the third NPN transistor; and a fourth limiting resistor that is connected between the second shunt resistor and the fourth NPN transistor, the fourth liming resistor limiting a current flowing toward the fourth NPN transistor.

5. The constant current control circuit according to claim 2, further comprising:

a semiconductor substrate having thereon a first wiring and a second wiring, wherein:

the first and second semiconductor switching elements and the first and second drive circuits are formed in the semiconductor substrate;

the first shunt resistor is provided as a wiring resistance of the first wiring;

the second shunt resistor is provided as a wiring resistance of the second wiring;

the first and second NPN transistors of the first drive circuit are located blow the first wiring in the semiconductor substrate; and the third and fourth NPN transistors of the second drive circuit are located below the second wiring in the semiconductor substrate.

6. The constant current control circuit according to claim 2, further comprising:

a semiconductor substrate having thereon a first wiring and a second wiring;

wherein:

the first and second semiconductor switching elements and the first and second drive circuits are formed in the semiconductor substrate;

the first shunt resistor is provided as a wiring resistance of the first wiring;

the second shunt resistor is provided as a wiring resistance of the second wiring;

the first and second NPN transistors of the first drive circuit are aligned and are equal to each other in distance from the first semiconductor switching element; and the third and fourth NPN transistors of the second drive circuit are aligned and are equal to each other in distance from the second semiconductor switching element.

7. The constant current control circuit according to claim 1, wherein the first and second pads are integrated into a common pad.

8. The constant current control circuit according to claim 1, further comprising:

a semiconductor substrate;

wherein the first and second semiconductor switching elements and the first and second drive circuits are formed in the semiconductor substrate;

the first and second shunt resistors are formed on the semiconductor substrate; and the semiconductor substrate has a first trench isolation structure surrounding the first semiconductor switching element and a second trench isolation structure surrounding the second semiconductor switching element.

* * * * *